US007303390B2

(12) United States Patent
Heng-Wei

(10) Patent No.: US 7,303,390 B2
(45) Date of Patent: Dec. 4, 2007

(54) LIQUID OIL LAMPS

(76) Inventor: Tu David Heng-Wei, 2 Prescott Crt, Thornhill, Ontario (CA) L3T 5W7

( * ) Notice: Subject to any disclaimer, the term of this patent is extended or adjusted under 35 U.S.C. 154(b) by 0 days.

(21) Appl. No.: 11/378,773

(22) Filed: Mar. 20, 2006

(65) Prior Publication Data

US 2007/0218413 A1 Sep. 20, 2007

(51) Int. Cl.
*F23D 3/24* (2006.01)
*F23D 3/18* (2006.01)

(52) U.S. Cl. ..... 431/320; 431/324; 431/146

(58) Field of Classification Search ..... 431/320, 431/2, 146, 321–325, 128, 132; 215/272
See application file for complete search history.

(56) References Cited

U.S. PATENT DOCUMENTS 2,710,701 A * 6/1955 Hale ..... 215/219
3,365,088 A * 1/1968 Turner ..... 215/213
3,863,798 A * 2/1975 Kurihara et al. ..... 215/301
4,039,274 A * 8/1977 Nordlinger ..... 431/128
4,634,029 A * 1/1987 Hauser ..... 222/567
4,781,577 A * 11/1988 Stewart ..... 431/320
5,425,633 A * 6/1995 Cole ..... 431/291

* cited by examiner

*Primary Examiner*—Steve McAllister
*Assistant Examiner*—Chuka C Ndubizu
(74) *Attorney, Agent, or Firm*—David W. Wong

(57) ABSTRACT

A liquid fuel lamp is provided with a wick carrying composite safety cap which is mountable to and removable from the liquid fuel container only by simultaneous pressing and turning actions. The safety cap has a spring biassed latch and a wick guard surrounding in a spaced manner around the upper end portion of the wick.

11 Claims, 4 Drawing Sheets

LIQUID OIL LAMPS

BACKGROUND OF THE INVENTION

1. Field of the Invention

This invention relates to liquid fuel lamps and more particularly oil lamps that may be used for illumination or decorative purposes both indoor and outdoor. It may be mounted on a post to serve as a torch for outdoor purposes.

2. Background Art

Liquid fuel lamps employ a combustible oil such as kerosene, olive oil, and mineral oil provided within a container and a wick having one end dipped into the oil may be lighted at its upper end to provide an open flame for illumination or decorative purposes. Commonly, the wick is carried on a cap mounted at the top of the oil container. The cap merely rests or is press-fitted on the container and it can be easily removed for filling the container with the liquid fuel oil.

Liquid fuel lamps have been problematic, particularly due to the existing of the open flame which presents a potential fire hazard if the flame comes in contact with other combustible material or due to spillage of the oil from the container particularly if the latter is accidentally tipped over or due to leakage of the oil from the container. The open flame may also cause severe burn hazard if it is contacted accidentally. The combustible oil can cause serious health hazard with lethal consequences if ingested particularly by children. Moreover, the wick is mounted on a metal cap such that the cap may be heated to a high temperature which may cause spontaneous combustion of any liquid fuel coming into contact with such heated surface. Heretofore, such unfortunate mishaps have occurred frequently. The often occurrence of such instances of mishaps induces the establishment of the stringent safety standards such as the European Standard EN14059 stipulating the basic safety construction of such lamps in order to alleviate the above safety hazards. However, to-day no liquid fuel lamps meet the requirements of such safety standards.

SUMMARY OF THE INVENTION

It is a principal object of the present invention to provide liquid fuel lamps which complies with all the safety requirements of safety standards.

It is another object of the present invention to provide liquid fuel lamps in which the fuel is prevented from leakage from the container.

It is another object of the present invention to provide liquid fuel lamps having a child-proof cap mounting for preventing the fuel oil from accidentally being ingested by children.

It is yet another object of the present invention to provide liquid fuel lamps in which the wick is insulated from the mounting cap.

It is still another object of the present invention to provide liquid fuel lamps which has a leakage-proof cap to prevent leakage of the liquid fuel oil even when the container is accidentally overturned.

BRIEF DESCRIPTION OF THE DRAWINGS

Other objects and advantages of the present invention will become apparent from the following detailed description of the preferred embodiments thereof in connection with the accompanying drawings in which.

DETAILED DESCRIPTION OF THE PREFERRED EMBODIMENTS

Figure 3:
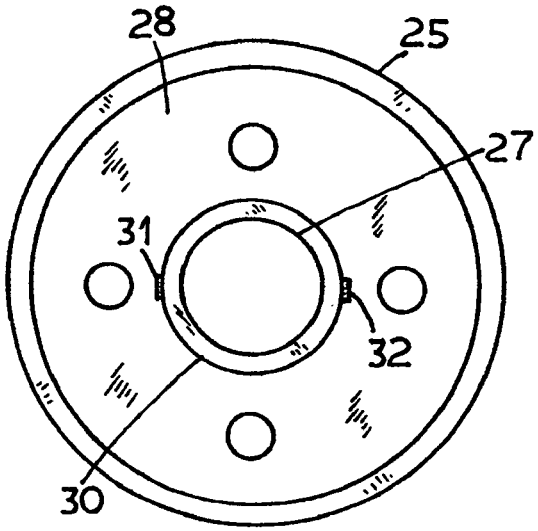
FIG. 3 is a perspective bottom elevation view of the latching plate and the shell of the safety cap.
Figure 2:
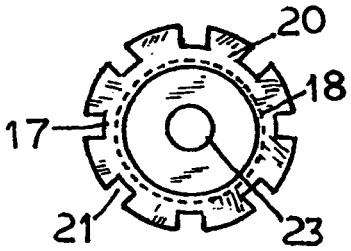
FIG. 2 is a perspective bottom elevation view of the casing of the safety cap.
Figure 1:
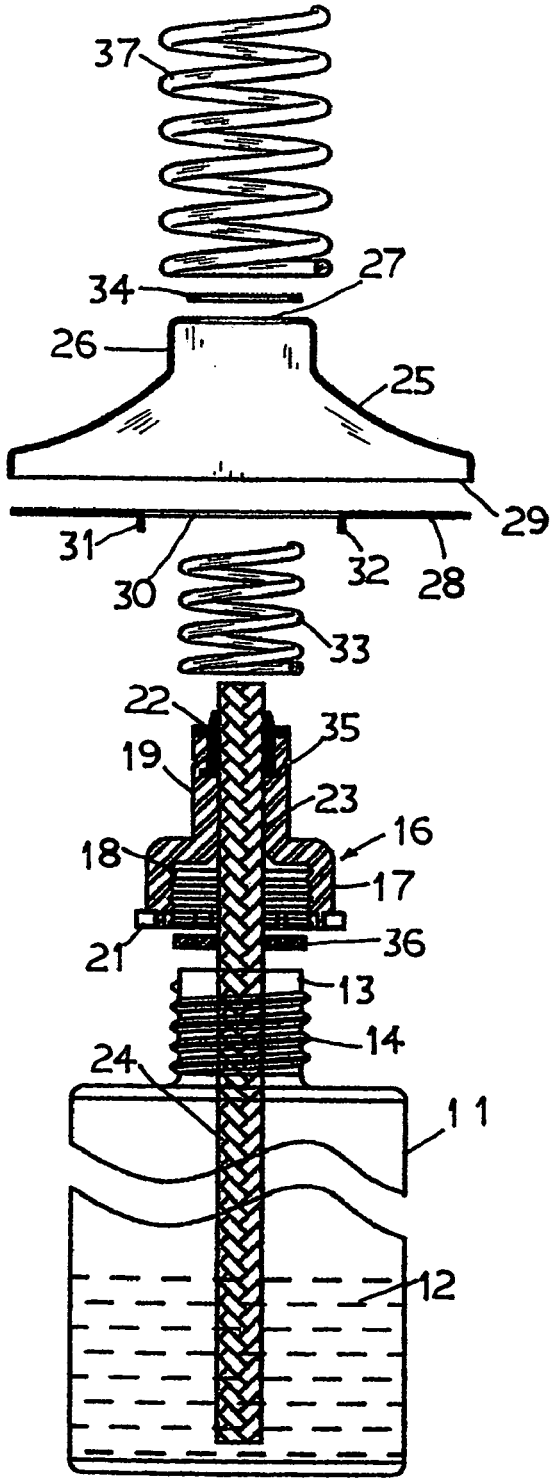
FIG. 1 is an exploded front elevation view of the liquid fuel lamp having a relatively tall liquid fuel container and one embodiment of a child-proof cap.
Figure 4:
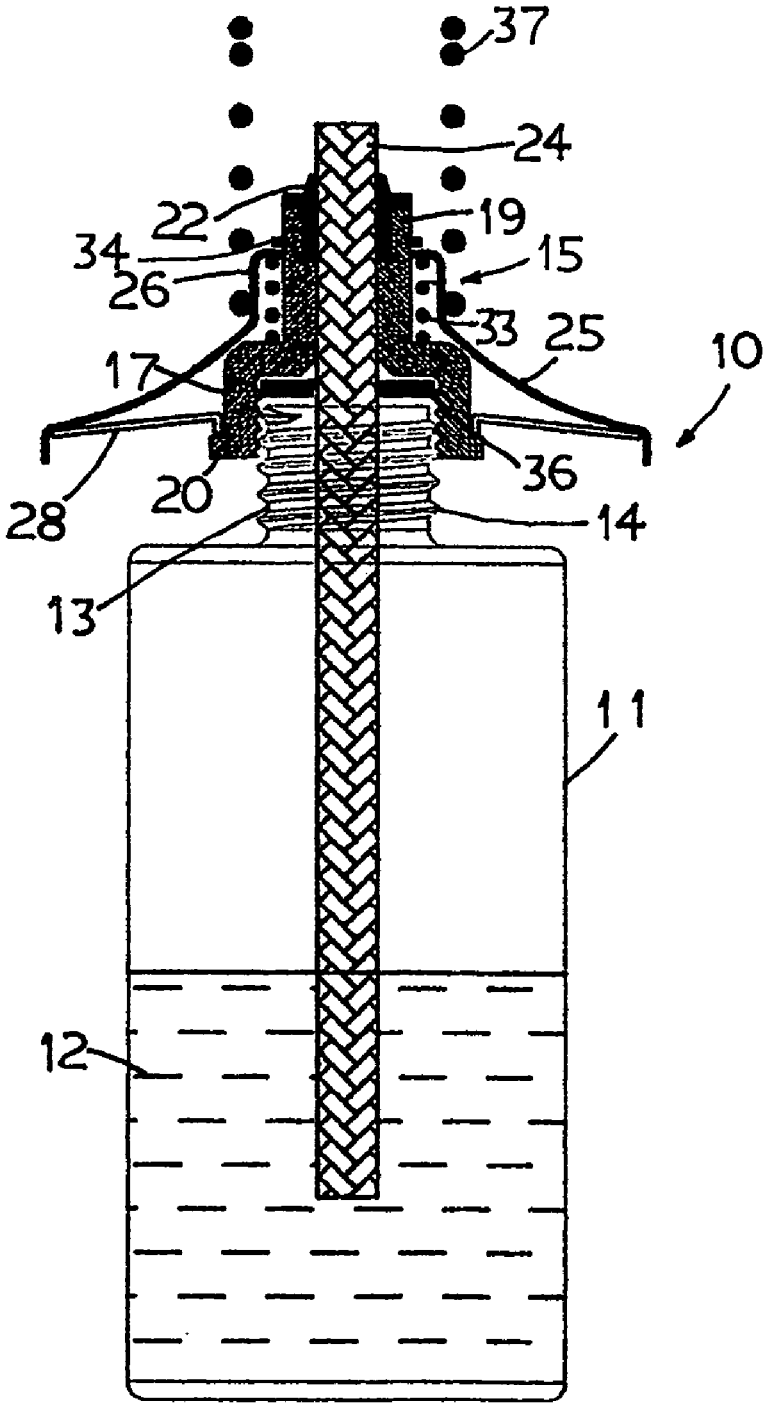
FIG. 4 is a partial sectional front elevation view of the liquid fuel lamp according to the present invention.
Figure 5:
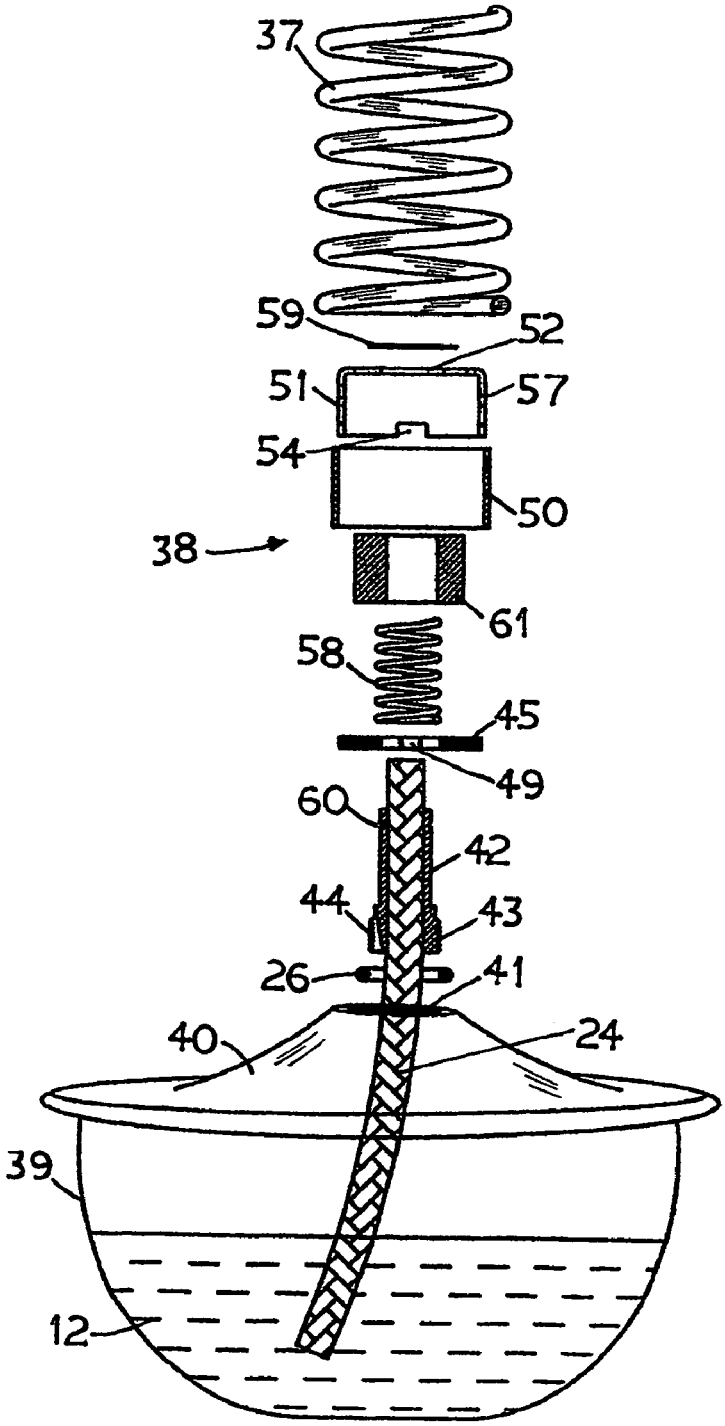
FIG. 5 is an exploded front elevation view of the liquid fuel lamp having a semi-spherical fuel container provided with a second embodiment of the safety cap according to the present invention.
Figure 7:
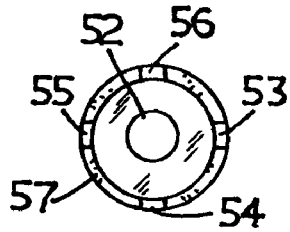
FIG. 7 is a perspective bottom elevation view of the locking collar of the second embodiment.
Figure 8:
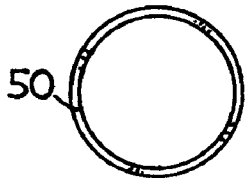
FIG. 8 is a perspective bottom elevation view of the short cylinder of the second embodiment.
Figure 6:
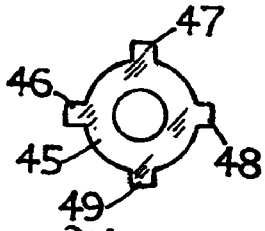
FIG. 6 is a perspective bottom elevation view of the latch plate of the second embodiment shown in FIG. 5.
Figure 9:
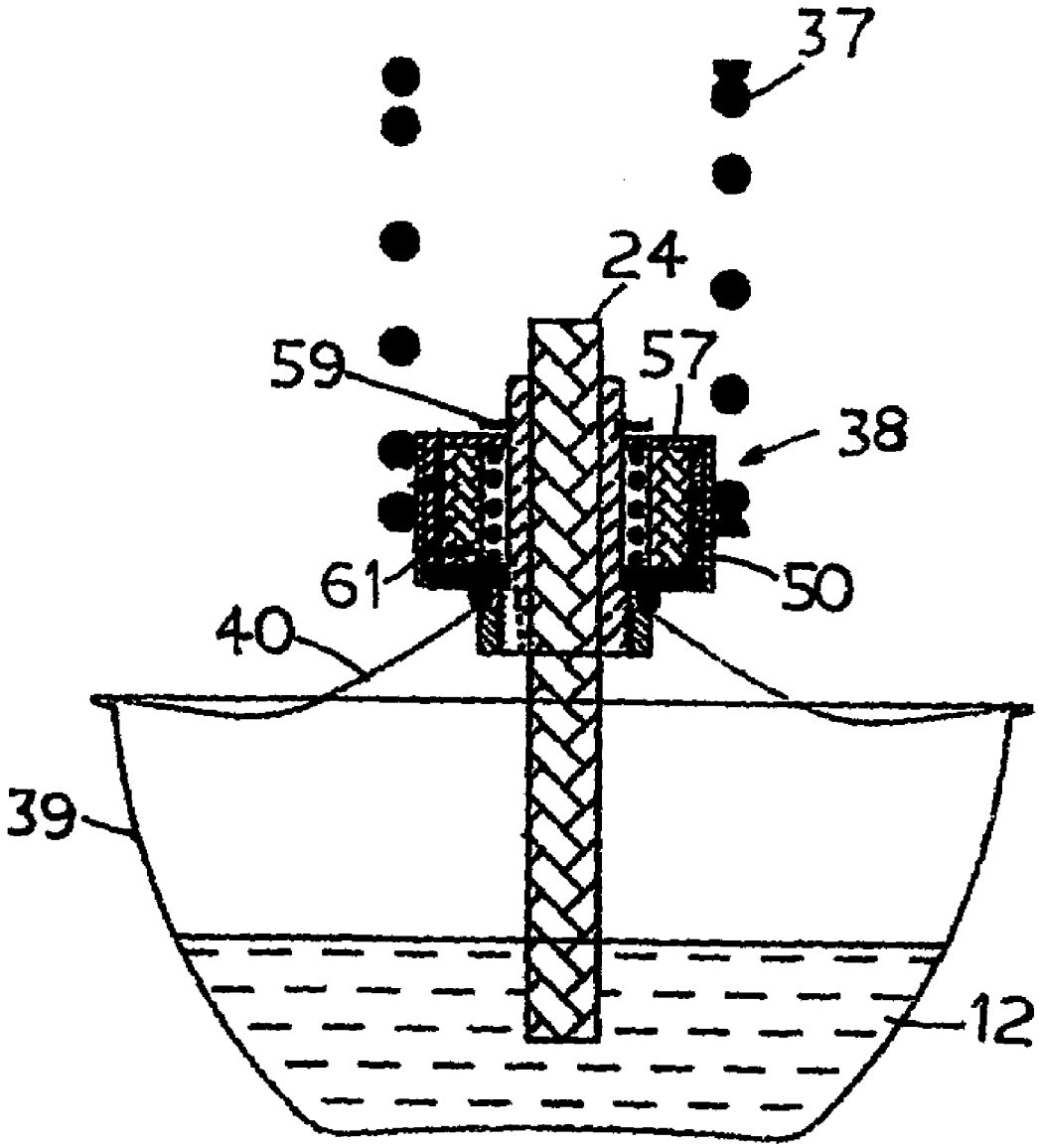
FIG. 9 is a partial sectional front elevation view of the liquid fuel lamp with the safety cap of the second embodiment.

With reference to the drawings in which like reference numerals designate corresponding parts in the several views, the liquid fuel lamp 10 of the present invention has a container 11 preferably made of a transparent or translucent plastic material such that the amount of fuel 12 in the container 11 is visible so as to provide a readily available indication to the user of whether addition or replenishment of the fuel would be required. The container 11 has an upper neck 13 with mounting reads 14 formed thereon. A composite safety cap 15 is threadingly mountable on the neck 13. The threaded mounting is shown as an exemplary embodiment of the present invention, it will be understood by those skilled in the art that other forms of mounting means such as a bayonet mounting may be employed to provide a similar function. The safety cap 15 has a circular adapter 16 made of a high temperature plastic or phenolic material such as Bakelite (a trade mark) and it has a circular casing 17 having mounting threads 18 formed on its inner surface such that the circular casing 17 may engage with the mounting threads or similar complementary mounting means 14 on the neck 13 of the fuel container 11 for securing to the latter. A cylindrical upper sleeve portion 19 is integrally formed on the circular casing 17 and it extends upwardly therefrom. An extended circular rim 20 having a larger diameter than the circular casing 17 is also integrally formed at the lower edge of the circular casing 17 such that it extends outwards from the circumference of the lower edge of the circular casing 17. At least two open slots 21 are formed at diametrically opposite positions in the circular rim 20 and preferably a plurality of such open slots 21 are formed in evenly spaced diametrically opposite positions in the circular rim 20 as shown in FIG. 2. A generally T-shaped metal sleeve carrier 22 is mounted or integrally molded at the top portion of the upper sleeve portion 19. The metal sleeve carrier 22 may be made of copper or brass. The main body 16 has an inner through opening 23 extending through the circular casing 17, the upper sleeve portion 19 and the metal sleeve carrier 22. The wick 24 for the lamp is slidably mounted in the main body 16 through the opening 23.

The safety cap 15 has a generally frusto-conical or bell-shaped top shell 25 which preferably has a lower diameter larger than the diameter of the container 11 so as to prevent any kindling material from the burning wick from dropping onto the container 11. The shell 25 has a short cylindrical top portion 26 extending upwards from its center and it has an opening 27 which has a diameter equal to the outside diameter of the upper sleeve portion 19 of the adapter 16. A circular latching plate 28 is mounted at the bottom opening 29 of the shell 25. The latching plate 28 has a central opening 30 which has a diameter slightly larger than the outside diameter of the casing 17 but smaller than the outside diameter of the circular rim 20. Two vertical tabs 31 and 32 formed at diametrically opposite locations of the edge of the central opening 30. The width of the tabs 31 and 32 is smaller than the open slots 21 formed in the circular rim 20 of the circular casing 17. A spiral compression spring 33 is disposed around the upper sleeve portion 19 of the main body 16. The spring 33 has an inside diameter larger than the outside diameter of the upper sleeve portion 19 and an outside diameter larger than the opening 27 at the top of the cylindrical top portion 26 so that its bottom rests on the circular casing 17 and its top is in abutment with the inner surface of the rim of the opening 27. The main body 16 extends upwards through the opening 27 of the shell 25 and is secured in place by a spring lock washer 34 engages with a circular slot 35 formed around the upper sleeve portion 19. The shell 25 may be pressed downwards against the spring force of the compressing spring 33 while turning to engage the tabs 31 and 32 with the open slots 21 of the circular rim 20 for turning the casing 16 for either securing or removing the safety cap 15 from the neck 13 of the container 11. This double action requirement safeguard that safety cap 15 may not be operated by children to remove it from the container 11. An oil seal 36 is provided between the casing 16 and the top edge of the neck 13 of the container 11 so as to prevent leakage of the liquid fuel 12 from the container 11 when the safety cap 15 is tightly mounted to the neck 13.

A spiral spring 37 having an inside diameter equal to that of the cylindrical top portion 26 of the shell 25 may be mounted to the cylindrical top portion 26 to provide a safety guard for the wick 24 and the flame. The spacing between the spiral of the spring 37 is preferably less than ¼ inch so as to prevent children from accidentally touching the flame with their fingers.

A second embodiment of a composite safety cap 38 according to the present invention is shown in FIGS. 5 through 9. The safety cap 38 is particularly suitable for use with a metal fuel container 39 which has a metal top cover 40 with a central threaded opening 41. The safety cap 38 has a metal tubular sleeve carrier 42 having a threaded lower end portion 43 which is engageable with the central threaded opening 41 of the fuel container top cover 40 for mounting thereto. The wick 24 is slidably mounted within the tubular sleeve carrier 42. An oil seal 26 is located between the tubular sleeve carrier 42 and the container top cover 40, and a threaded ring 44 is also mounted on the threaded lower end portion 43 of the tubular sleeve carrier 42 such that it may be adjusted to secure the oil seal 26 tightly over the opening 41 so as to prevent any leakage of liquid fuel from the container 38. A circular latch plate 45 is fixedly mounted on the tubular sleeve carrier 42 and located above the threaded lower end portion 43. The latch plate 45 has four evenly spaced extension tabs 46, 47, 48 and 49 formed in its periphery, in which the tabs 46 and 48 are located diametrically directly opposite to one another and the tabs 47 and 49 are similarly located directly opposite to one another diametrically. The latch plate 45 is slidably located within the lower portion of a short cylinder 50 and rotatable relative thereto. A locking collar 51 having a cross-sectional inverted U shape is fixedly mounted within the upper portion of the cylinder 50. The locking collar 51 has a central opening 52 which has a slightly larger diameter than the outside diameter of the tubular sleeve carrier 42. Four open slots 53, 54, 55 and 56 are formed at the lower edge of the circular side wall 57 of the locking collar 51. The open slots 53 and 55 are located diametrically directly opposite to one another and the open slots 54 and 56 are similarly located diametrically directly opposite to one another. The width of the open slots 53, 54, 55 and 56 is slightly wider the width of the tabs 46, 47, 48 and 49 of the latch plate 45. A spiral compression spring 58 surrounds the upper portion of the tubular sleeve carrier 42 and rests on the latch plate 45. The upper portion of tubular sleeve carrier 42 extends through the central opening 52 of the locking collar 51 and a lock washer 59 is secured to tubular sleeve 42 by engaging with a circular slot 60 formed on the upper portion of the tubular sleeve 42. Thus, the lock washer 59 maintains the tubular sleeve carrier 42 slidably mounted to the locking collar 51, and the locking collar 51 is movable vertically to engage the tabs 46, 47, 48 and 49 with the open slots 53, 54, 55 and 56 by a depressing action against the spring force of the compression spring 58. The compression spring 58 maintains the tabs normally disengaged from the open slots. Accordingly, in order to secure or to remove the safety cap 38 from the fuel container 39, it would require both the pushing downward action and the turning action to be executed simultaneously similar to that in the embodiment described previously. A cylindrical foam tube 61 may be provided between the short cylinder 50 and the compression spring 58 to insulate the tubular sleeve 42 from the short cylinder 50.

A spiral spring 37 similar to that of the above first embodiment, may also be secured to the short cylinder 50 to provide a guard for the wick as well as against accidental touching of the flame by children.

While the preferred embodiments of the invention have been described above. It will be recognized and understood that various modifications may be made therein and the appended claims are intended to cover all such modifications which may fall within the spirit and scope of the invention.

What is claimed is:

1. A liquid fuel lamp comprising:

a liquid fuel container having a neck portion with a fuel filling opening, a safety cap having a spring-biassed latch operative only with a downward pressing action and a turning action simultaneously for selectively securing to and removing from said neck portion of said container, wherein the safety cap is selectively secured when the lamp is in operation an oil seal located between said safety cap and said neck portion of said container, a wick slidably extending through a metal sleeve carrier mounted in a heat insulating sleeve located in main body and said wick having a bottom end portion extending into said container to immerse in said liquid fuel.

2. A liquid fuel lamp comprising:

a cylindrical liquid fuel container having a neck portion with a fuel filling opening, said neck portion having mounting threads formed thereon, and said container having an outside diameter, a composite safety cap having a cylindrical main body and an upper sleeve portion made of a heat insulating plastic material, said main body being slidably mounted within a frusto-conical shell, and said main body being movable in a vertical direction within said shell against spring force of a bias spring disposed between an upper cylindrical portion of said shell and said main body, said main body having a cylindrical cap casing with threads formed on an inner surface therein and operative for engaging with said mounting threads on said neck portion for mounting to said container, said frusto-conical shell having a bottom circular portion with an outside diameter larger than said outside diameter of said container, a latch plate mounted at a bottom of said shell, said latch plate having at least two downwardly extending tabs formed therein, a circular extension rim formed at a bottom edge of said cap casing, said extension rim having a plurality of open slots formed therein, said open slots being engageable with said tabs of said latch plate by pressing said shell downward relative to said main body, an oil seal located between said neck portion and said cap casing, a wick slidably located in a metal sleeve carrier mounted in said upper sleeve portion of said main body, said wick having a bottom end portion extending within said container and immersed in said liquid fuel.

3. A liquid fuel lamp according to claim 2 wherein said bias spring is a spiral spring located between said cap casing and said shell and is operative for maintaining said tabs normally disengaged with said open slots.

4. A liquid fuel lamp according to claim 3 including a lock washer mountable to a circumferential slot formed at an upper portion of said cylindrical sleeve for mounting said main body to said shell.

5. A liquid fuel lamp according to claim 4 wherein said cap casing and said cylindrical sleeve are integrally formed with a high temperature plastic material.

6. A liquid fuel lamp according to claim 5 wherein said cap casing and said cylindrical sleeve are integrally formed with a phenolic material and said metal sleeve carrier is molded in a top portion of said cylindrical sleeve.

7. A liquid fuel lamp according to claim 6 wherein said open slots are formed in evenly spaced positions of said extension rim of said cap casing, and said tabs are formed at diametrically opposite positions on a circular edge of a central opening of said latch plate.

8. A liquid fuel lamp according to claim 7 including a spiral spring mounted on said shell and positioned in a spaced manner surrounding a top end of said wick.

9. A liquid fuel lamp comprising:

a liquid fuel container having a fuel filling opening formed in a top portion therein, said opening having mounting threads formed thereon, a composite safety cap having a cylindrical main body and a cylindrical cap casing slidably mounted within said main body, said cylindrical cap having a cylindrical side wall, at least two open slots formed at diametrically opposite positions in a lower edge of said cylindrical side wall of said cylindrical cap, a latch plate fixedly mounted at a lower edge portion of said cylindrical main body, said latch plate having an outer periphery with evenly spaced tabs formed thereon, said tabs being engageable with two diametrically positioned ones of said open slots of said cylindrical cap, a wick slidably mounted in and extending through a carrier having a threaded lower portion therein engageable with said threaded opening for mounting to said container with a lower end portion of said wick extending within said container to immerse in said liquid fuel, said sleeve extending upwards through a central opening formed in said latch plate and said cap casing, a heat insulating sleeve located between said cylindrical cap and said carrier, an oil seal mounted between said sleeve and said top portion around said fuel filling opening of said container, a compression spring disposed between said latch plate and said cap casing, a lock washer engageable with a circumferential circular slot formed at an upper portion of said sleeve for mounting said sleeve to said cap casing, and said cap casing is movable slidably in a vertical direction relative to said cylindrical main body against spring force of said compression spring for engaging said tabs with said open slots and turning said cap casing simultaneously for securing and removing said main body from said container.

10. A liquid fuel lamp according to claim 9 including a spiral spring mounted to said cylindrical main body and surrounding a top end portion of said wick in a spaced manner to prevent touching of said wick when top end portion of said wick is ignited.

11. A liquid fuel lamp according to claim 2 including a spiral spring slidably mounted on said upper cylindrical portion of said shell and surrounding a top end portion of said wick in a spaced manner for preventing accidental touching of said wick when said top end portion of wick is ignited.

* * * * *